US007788926B2

(12) United States Patent
Johnson et al.

(10) Patent No.: US 7,788,926 B2
(45) Date of Patent: Sep. 7, 2010

(54) RESONATOR DEVICE AT JUNCTION OF COMBUSTOR AND COMBUSTION CHAMBER

(75) Inventors: Clifford E. Johnson, Orlando, FL (US); Samer P. Wasif, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 1055 days.

(21) Appl. No.: 11/506,993

(22) Filed: Aug. 18, 2006

(65) Prior Publication Data

US 2008/0041058 A1 Feb. 21, 2008

(51) Int. Cl.
*F02C 7/24* (2006.01)
*F02C 3/00* (2006.01)
*B64F 1/26* (2006.01)

(52) U.S. Cl. ..... 60/725; 60/39.37; 181/210

(58) Field of Classification Search ..... 60/725, 60/39.37, 752–760; 181/210, 213, 211, 214, 181/250, 266, 276; 431/114
See application file for complete search history.

(56) References Cited

U.S. PATENT DOCUMENTS 2,654,219 A 10/1953 Zaba
4,422,300 A 12/1983 Dierberger et al.
4,449,607 A * 5/1984 Forestier et al. ..... 181/213
4,695,247 A 9/1987 Enzaki et al.
5,373,695 A 12/1994 Aigner et al.
5,431,018 A 7/1995 Keller
5,598,697 A 2/1997 Ambrogi et al.
5,644,918 A 7/1997 Gulati et al.
5,685,157 A 11/1997 Pandalai et al.
5,687,572 A 11/1997 Schrantz et al.
5,924,288 A 7/1999 Fortuna et al.
6,164,058 A 12/2000 Dobbeling et al.
6,282,905 B1 9/2001 Sato et al.
6,351,947 B1 * 3/2002 Keller et al. ..... 60/725
6,370,879 B1 4/2002 Stalder et al.
6,530,221 B1 * 3/2003 Sattinger et al. ..... 60/725
6,594,999 B2 7/2003 Mandai et al.
6,634,457 B2 10/2003 Paschereit et al.
6,640,544 B2 * 11/2003 Suenaga et al. ..... 60/725
6,837,051 B2 1/2005 Mandai et al.
6,907,736 B2 6/2005 Ohnishi et al.
6,964,170 B2 11/2005 Alkabie
6,983,820 B2 * 1/2006 Boast et al. ..... 181/249
7,076,956 B2 * 7/2006 Young et al. ..... 60/725
7,080,514 B2 * 7/2006 Bland et al. ..... 60/725
7,089,741 B2 * 8/2006 Ikeda et al. ..... 60/725

(Continued)

*Primary Examiner*—Michael Cuff
*Assistant Examiner*—Young Choi

(57) ABSTRACT

One or more Helmholtz-type resonators (270) is/are provided at the junction (260) of a combustor (220) and a combustion chamber (240) of a gas turbine engine (100). In one embodiment, adjacent Helmholtz-type resonators (290, 291, 292), which may be separated by respective baffles (285), have different volumes that help provide for damping different undesired combustion-generated acoustic pressure waves. In some embodiments, a structural member (435) may be provided between adjacent Helmholtz-type resonators (425, 426, 427, 428) at the junction. At least one of the plurality of Helmholtz-type resonators comprises one or more inlet openings (480), and one or more exit openings (482). Embodiments (370, 425-429) are described in which Helmholtz-type resonators provided at the junction are enlarged in size using various approaches. The positioning at the junction, upstream of the space (242) in which combustion occurs, and providing a plurality of differently sized resonators, provides for improved flexibility and resonator damping efficiencies.

19 Claims, 5 Drawing Sheets

U.S. PATENT DOCUMENTS

| | | | | |
|---|---|---|---|---|
| 7,194,862 | B2 * | 3/2007 | Sattinger | 60/725 |
| 7,461,719 | B2 * | 12/2008 | Tobik et al. | 181/213 |
| 7,549,506 | B2 * | 6/2009 | Sattinger | 181/213 |
| 2004/0172948 | A1 | 9/2004 | Bellucci et al. | |
| 2004/0211185 | A1 | 10/2004 | Young et al. | |
| 2005/0144950 | A1 | 7/2005 | Flohr et al. | |
| 2007/0256889 | A1 * | 11/2007 | Yu et al. | 181/214 |
| 2009/0084100 | A1 * | 4/2009 | Johnson et al. | 60/375 |

* cited by examiner

RESONATOR DEVICE AT JUNCTION OF COMBUSTOR AND COMBUSTION CHAMBER

FIELD OF INVENTION

The invention generally relates to a gas turbine engine, and more particularly to a resonator positioned at a junction of a combustor and a mating combustion chamber of a can-annular gas turbine engine.

BACKGROUND OF THE INVENTION

Combustion engines such as gas turbine engines are machines that convert chemical energy stored in fuel into mechanical energy useful for generating electricity, producing thrust, or otherwise doing work. These engines typically include several cooperative sections that contribute in some way to this energy conversion process. In gas turbine engines, air discharged from a compressor section and fuel introduced from a fuel supply are mixed together and burned in a combustion section. The products of combustion are harnessed and directed through a turbine section, where they expand and turn a central rotor.

A variety of combustor designs exist, with different designs being selected for suitability with a given engine and to achieve desired performance characteristics. One popular combustor design includes a centralized pilot burner (hereinafter referred to as a pilot burner or simply pilot) and several main fuel/air mixing apparatuses, generally referred to in the art as injector nozzles, arranged circumferentially around the pilot burner. With this design, a central pilot flame zone and a mixing region are formed. During operation, the pilot burner selectively produces a stable flame that is anchored in the pilot flame zone, while the fuel/air mixing apparatuses produce a mixed stream of fuel and air in the above-referenced mixing region. The stream of mixed fuel and air flows out of the mixing region, past the pilot flame zone, and into a main combustion zone, where additional combustion occurs. Energy released during combustion is captured by the downstream components to produce electricity or otherwise do work.

It is known that high frequency pressure oscillations may be generated from the coupling between heat release from the combustion process and the acoustics of the combustion chamber. If these pressure oscillations, which are sometimes referred to as combustion dynamics, reach a certain amplitude they may cause nearby structures to vibrate and ultimately break. A particularly undesired situation is when a combustion-generated acoustic wave has a frequency at or near the natural frequency of a component of the gas turbine engine. Such adverse synchronicity may result in sympathetic vibration and ultimate breakage or other failure of such component Various modifications of and devices for the combustion section of a gas turbine engine have been developed to address the problem of combustion-generated acoustic waves. For example, U.S. Pat. No. 6,164,058 issued Dec. 26, 2000, to Dobbeling et al., teaches a quarter wave resonator extending either into the diffuser or into an annular collecting space about the combustor. U.S. Pat. No. 5,685,157, to Pandalai et al., also teaches a quarter wave resonator, however here a plurality of closed-end resonators are provided circumferentially around the burners of the engine.

Other approaches to damp undesired acoustic vibration utilize a Helmholtz resonator. A plurality of such resonators may be placed along the outside surface of the combustion chamber or the transition downstream of the combustion chamber. The latter is done for example, in U.S. Pat. No. 6,530,221, issued Mar. 11, 2003, to Sattinger et al. The Sattinger et al. patent teaches the placement of damping modular resonators at locations having the highest acoustic pressure amplitude, which for a particular gas turbine engine was identified to be at two locations in the transition. This patent also teaches the positioning of modular resonators disposed in the flow path in positions adjacent to tubular members that house combustor elements. U.S. Pat. No. 6,640,544, issued Nov. 4, 2003, to Suenage et al., and U.S. Pat. No. 6,837,051, issued Jan. 4, 2005, to Mandai et al., teach aspects of resonators positioned along the outer wall structure of combustion chambers.

It is recognized that a fixed volume resonator may damp vibrations only within a defined range of frequencies based upon its volume and aspects of the opening leading into it from the source of vibrations. To address this issue, U.S. Pat. No. 6,634,457, issued Oct. 21, 2003 to Paschereit et al., teaches a device for damping combustor acoustic vibrations in which the volume of a Helmholtz resonator can be changed by adding or draining a fluid via a supply line, or by other means.

U.S. Pat. No. 5,644,918, issued Jul. 8, 1997 to Gulati et al., teaches the installation of Helmholtz resonators in two relatively upstream locations. One or more "head end" resonators may be placed adjacent and lateral to the fuel nozzle assemblies in the combustor area. Tubes extend from the combustion chamber into respective the cavities of the respective "head end" resonators, which are within a main axial flow path of air entering for combustion. The "side-mounted" resonators are spaced apart from the combustion chamber, and are positioned circumferentially in a space through which compressed air passes as it flows into the combustor. Tubes extend through that space from the combustion chamber to communicate with the cavities of such "side-mounted" resonators.

Also, a Helmholtz resonator for an annular combustor of a gas turbine engine is taught in US patent publication number US2005/0144950 A1, published Jul. 7, 2005, having inventors Flohr et al. The Helmholtz resonator is integrated into a combustor insert, which is located between a combustor and a combustion chamber. Small tubes provide fluid communication between an upstream end of the combustion chamber and the resonator, and the latter also is shown to comprise air inlets.

While the above approaches may provide one or more favorable features, there still remains in the art a need for a more effective and efficient resonator, and for a gas turbine engine comprising such resonator, to address undesired combustion-generated acoustic waves.

BRIEF DESCRIPTION OF THE DRAWINGS

The invention is explained in following description in view of the drawings that show.

DETAILED DESCRIPTION OF EMBODIMENTS OF THE INVENTION

Embodiments of the invention provide a number of advances over known arrangements and designs of acoustic dampers for combustors. The various embodiments provide a plurality of separate resonator chambers at a junction of a combustion chamber and a combustor. The combustor typically is defined externally by a combustor housing that meets the combustion chamber to form the junction. Resonator chambers at this junction, in various embodiments, are designed and tuned to damp two or more undesired acoustic frequencies of interest that are generated during combustion operations. Given that this position is more upstream of the areas of maximum combustion, and far less subject to a risk of hot gas ingestion than more downstream-located resonators, there is greater flexibility with regard to flow design. This provides opportunities for improved resonator damping efficiency and for narrower targeting of frequencies to damp. This is because less inflow is required to prevent incursion of flames into the resonator chambers in such more upstream position.

Also, rather than using tubes to define an extended throat of a particular resonator, various embodiments comprise a throat having a length defined only by the overall thickness of the structure separating the resonator chamber (also referred to as 'cavity') from the internal space of the combustion chamber. This provides for a plurality of Helmholtz-type resonator cavities to fit directly around such upstream junction, with each of such plurality of cavities comprising one or more openings that communicate with space within the combustion chamber. Further, lacking such tubes, these resonators are formed so that at least a portion of the cavity of the resonator conforms to the outer structure of the junction and/or the combustion chamber and/or the combustor. This provides for greater structural integrity, and lower probability of component failure. This also teaches away from those in the art who emphasize the importance of various features of tubes for Helmholtz resonators.

These and other aspects in combination, as exemplified in the figures and as discussed further below, provide for resonators, and gas turbine engines comprising such resonators, that are effective to render this junction and, more generally the upstream region of the combustion chamber, more acoustically compliant, and effective to dissipate two or more undesired acoustic frequencies generated during combustion operations. Further, in various embodiments this is provided by use of Helmholtz-type resonators, and without the use of quarter-wave resonators.

Figure 1:
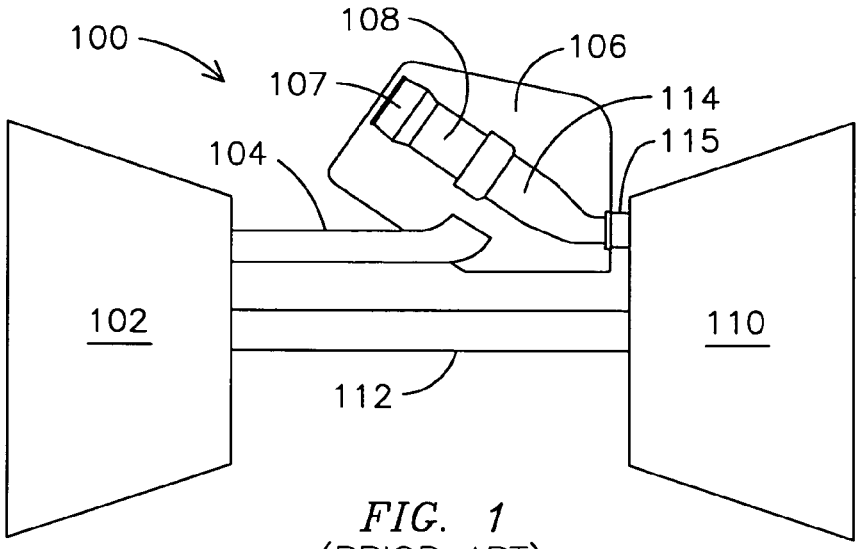
FIG. 1 (PRIOR ART)
FIG. 1 provides a schematic cross-sectional depiction of a prior art gas turbine engine.

First, however, a discussion is provided of a common arrangement of elements of a prior art gas turbine engine into which may be provided embodiments of the present invention. FIG. 1 provides a schematic cross-sectional depiction of a prior art gas turbine engine 100 such as may comprise various embodiments of the present invention. The gas turbine engine 100 comprises a compressor 102, a combustor 107, a combustion chamber 108 (the latter two may be arranged in a can-annular design), and a turbine 110. During operation, in axial flow series, compressor 102 takes in air and provides compressed air to a diffuser 104, which passes the compressed air to a plenum 106 through which the compressed air passes to the combustor 107, which mixes the compressed air with fuel (not shown), and directly to the combustion chamber 108, and thereafter largely combusted gases are passed via a transition 114 to the turbine 1 10, which may generate electricity. A shaft 112 is shown connecting the turbine to drive the compressor 102. Although depicted schematically as a single longitudinal channel, the diffuser 104 extends annularly about the shaft 112 in typical gas turbine engines, as does the plenum 106. The junction discussed below is the junction between the more upstream (in terms of major flow of compressed air) combustor 107, and the adjacent, more downstream combustion chamber 108. It may be referred to as an 'upstream junction' of the combustion chamber 108, which also has a 'downstream junction' with the transition 114.

Figure 2B:
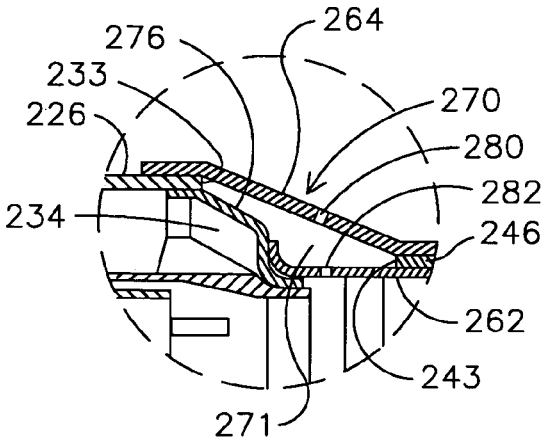
FIG. 2B provides an enlarged view of a portion of the junction encircled in FIG. 2A, depicting modifications to form a resonator now utilizing formerly non-utilized space as its cavity.
Figure 2A:
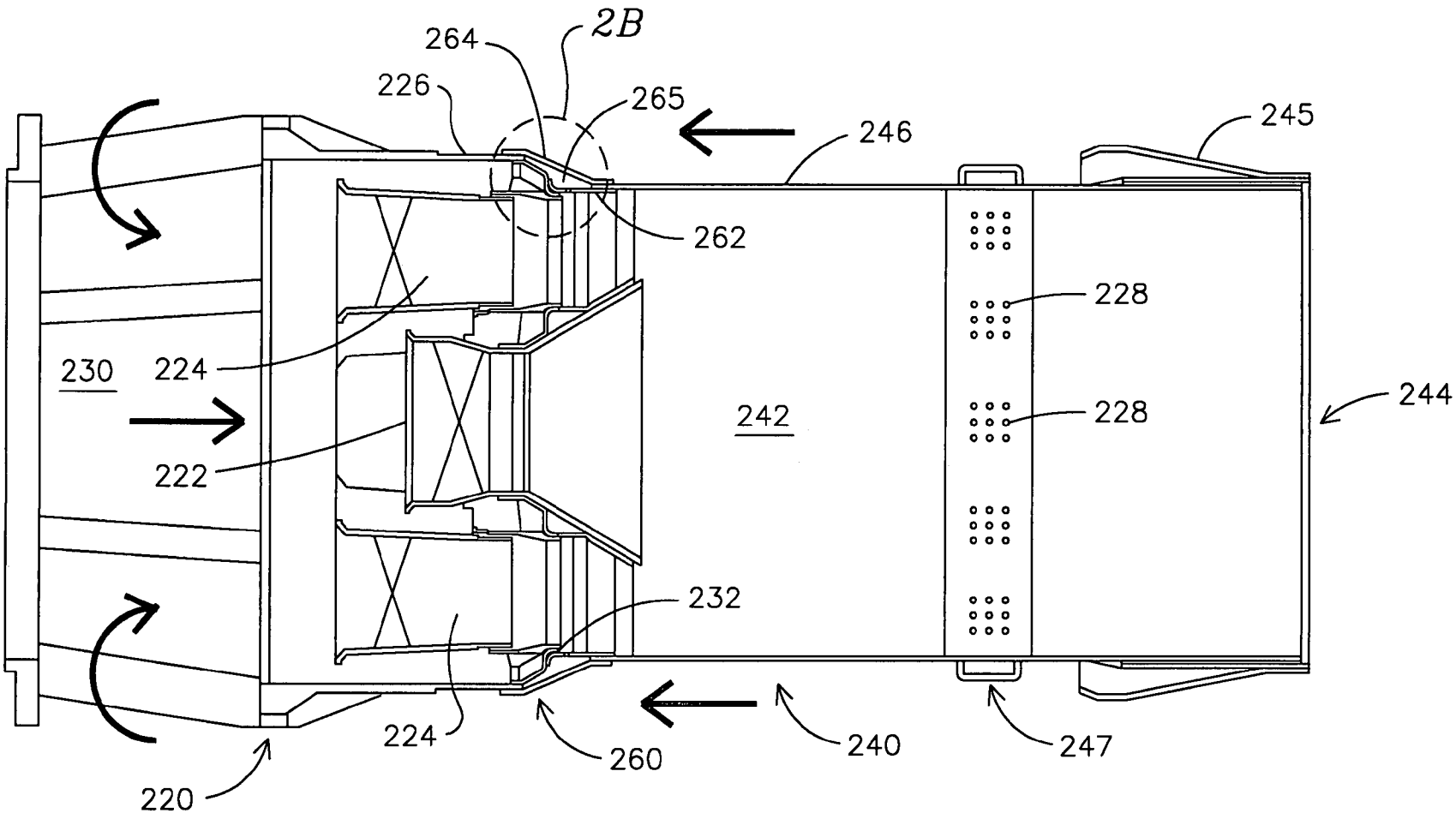
FIG. 2A provides a cross-sectional cut-away view of a combustor joined to a combustion chamber at a junction.

FIG. 2A provides a cross-sectional view of a combustor 220 joined with a combustion chamber 240 at a junction 260, alternatively referred to as an upstream junction with regard to the combustion chamber 240. The combustor 220 is comprised of a pilot swirler assembly 222 (or more generally, a pilot burner), and disposed circumferentially about the pilot swirler assembly 222 are a plurality of main swirler assemblies 224. These are contained in a combustor housing 226. Fuel is supplied to the pilot swirler assembly 222 and separately to the plurality of main swirler assemblies 224 by fuel supply rods (not shown). A transversely disposed base plate 232 of the combustor 220 receives downstream ends of the main swirler assemblies 224.

During operation, a predominant air flow (shown by thick arrows) from a compressor (not shown) passes along the outside of combustor housing 226 and into an intake 230 of the combustor 220. The pilot swirler assembly 222 operates with a relative richer fuel/air ratio to maintain a stable inner flame source, and combustion takes place downstream of the junction 260 in the space 242 within the combustion chamber 240. The outer boundary of the combustion chamber 240 is defined by a combustor basket liner 246. An outlet 244 at the downstream end of combustion chamber 240 passes combusting and combusted gases to a transition (not shown, see FIG. 1), which is joined by means of a combustor-transition interface seal, depicted in the figure as a spring clip assembly 245.

Also viewable in FIG. 2A is an optional array of downstream resonators 247 having a plurality of openings 228 communicating with the space 242 at a location relatively closer to the outlet 244 than to the junction 260. In various embodiments, these may be provided to supplement resonators at the junction 260, which are more clearly depicted in FIG. 2B.

In various existing gas turbine engine designs, a cavity, identified by 265 in FIG. 2A, exists at the junction 260. While not meant to be limiting, the junction 260 in FIG. 2A is comprised of an outer baseplate ring 262, which forms a circumferential barrier for a short axial distance to contain the flow of fuel/air mixture passing from the combustor 220 to the combustion chamber 240. This structure may be more generally referred to as an inner junction ring. In various designs, the inner junction ring may or may not provide a complete barrier to fluid flow between the inner flow of air/fuel mixture and the relatively higher pressure outer flow of compressed air heading toward the intake 230. Also not meant to be limiting, the junction 260 in FIG. 2A also comprises an outer connector ring 264 that connects, such as by welding, to the combustor housing 226 at its upstream end and to the combustor basket liner 246 at its downstream end. This structure may be more generally referred to as an outer junction ring, and this primarily has a function to rigidly join the combustor 220 joined with the combustion chamber 240. The cavity 265 formed between the outer baseplate ring 262 and the outer connector ring 264 has served no specific purpose, and has been formed, without specific function, between these elements used for structural joining of the combustor 220 with the combustion chamber 240.

In various embodiments, such as is depicted in FIG. 2B, the previously unused cavity 265 viewable in FIG. 2A is formed into one or into a plurality of resonators. More particularly, FIG. 2B shows a resonator 270 comprising a resonator cavity 271 defined to the exterior by the outer connector ring 264, to the upstream end by a downstream end 233 of combustor housing 226 and a portion 276 of a baseplate shroud 234 of combustor 220 (see FIG. 2A), to the interior by the outer baseplate ring 262, and at its downstream end by an upstream end 243 of the combustor basket liner 246. An inlet air hole 280 and an exit air hole 282 are shown. The exit air hole 282 communicates directly with the space within the combustion chamber (i.e., space 242, see FIG. 2A), while the inlet air hole 280 is in fluid communication with a flow of compressed air en route to the intake (i.e., intake 230 of the combustor (see FIG. 2A)).

Considering both FIGS. 2A and 2B, the resonator 270 curves in annular fashion at the junction 260. While a single resonator 270 may extend within the cavity defined between the outer connector ring 264 and the outer baseplate ring 262 to occupy the entire annular cavity of the junction 260 (and may comprise one each or a plurality of inlet and exit air holes), in various embodiments the cavity 265 is partitioned by two or more baffles to form a plurality of adjacent resonators comprising respective resonator cavities (such as 271), with each such individual resonator comprising at least one inlet air hole and at least one exit air hole. This provides for tuning different resonators, defined laterally by baffles (such as solid baffle plates), to a number of different frequencies.

Figure 2C:
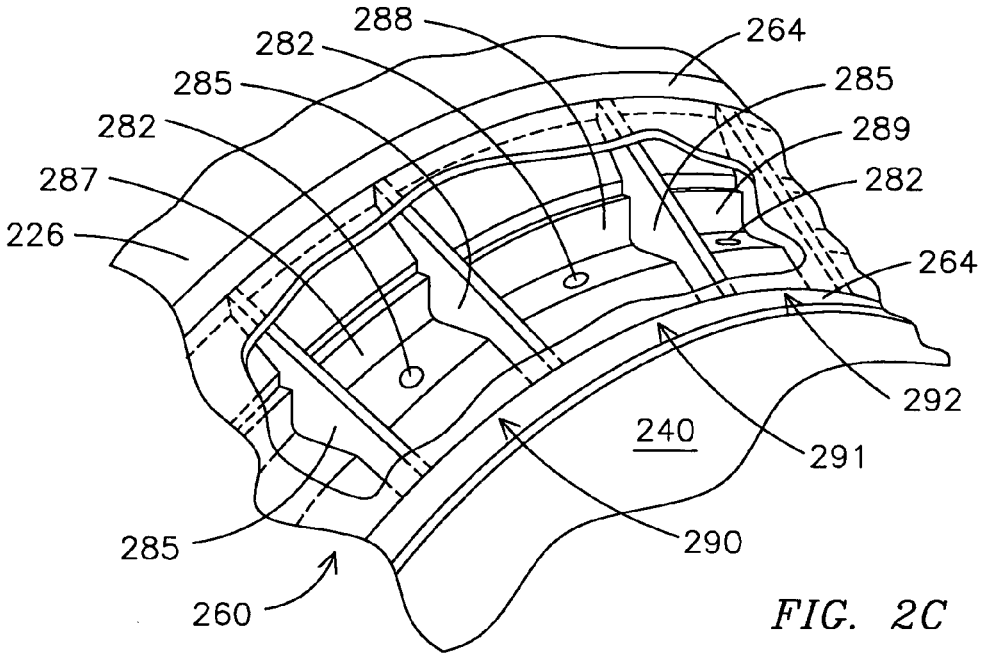
FIG. 2C provides a perspective view with a cut-away portion, from a side downstream point of view, of a combustor joined to a combustion chamber at a junction comprising an arrangement of adjacent resonators (such as depicted in FIG. 2B) at the junction.

For example, FIG. 2C provides a perspective view of a junction 260 between a combustor 220 and a combustion chamber 240 in which a plurality of transverse baffles 285 separate the cavity (see 265 in FIG. 2A) into a plurality of resonator chambers 287, 288, 289. Resonator chambers 287, 288, and 289 each communicate through a respective inlet air hole (not shown due to cut-away view, see FIG. 2B) and exit air hole 282, and with such respective inlet air holes and exit air holes 282 comprise resonators, respectively, annular adjoining resonators 290, 291 and 292. As may be appreciated, two or more of each of annular adjoining resonators 290, 291 and 292 may be provided circumferentially around junction 260 (albeit all are not viewable in FIG. 2C). Also, it is appreciated that more than a single inlet air hole, and more than a single exit air hole, may be provided for any of these resonators.

The embodiments depicted in FIGS. 2B and 2C demonstrate resonators that are integrated into the junction between the combustor and the combustion chamber. This provides for greater structural integrity, and for less likelihood of component failure, such as when tubes are extended from a combustion chamber to a resonator cavity that is more remote from, and not integral with, the combustion chamber. As noted above, this junction is referred to as an upstream junction in reference to its position relatively upstream of the combustion chamber.

Without being limiting, when two or more sizes of baffled resonators are constructed around the junction, each of these resonators of different sizes is designed to damp a particular, targeted critical combustion dynamic frequency in the range of about 1,000 to 5,000 cycles per second. More particularly, when two or more particular frequencies of concern are determined, the ranges of two or more resonators may be designed, and their ranges may be designed to overlap. For example, a first size resonator, of which there may be two or more arranged circumferentially about the junction, may be designed to damp a range of frequencies between about 2,000 and 2,400 cycles per second acoustic vibration, and a second size resonator, of which there may be two or more arranged circumferentially about the junction, may be designed to damp a range of frequencies between about 2,300 and 2,900 cycles per second acoustic vibration. Thus, the respective frequency ranges of the two sizes of resonators overlap. Other sizes of resonators also may be provided to damp additional critical combustion dynamic frequencies, and these likewise may be designed to have their frequency ranges also overlap, such as with the first two sizes of resonators. This example of two possible frequencies to damp is neither meant to be limiting nor indicative of actual frequencies to damp.

Figure 3B:
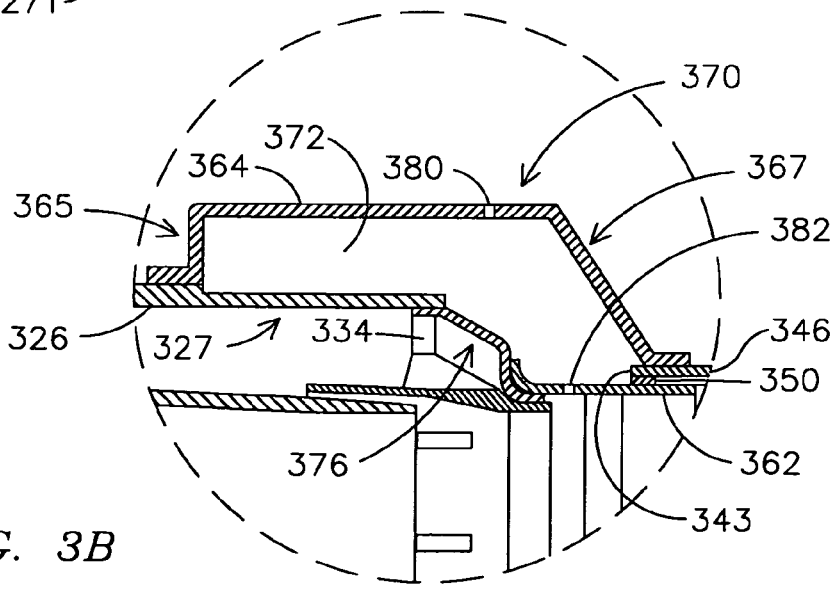
FIG. 3B provides an enlarged view of a portion of the junction encircled in FIG. 3A, depicting details of the enlarged resonator formed at the junction.
Figure 3A:
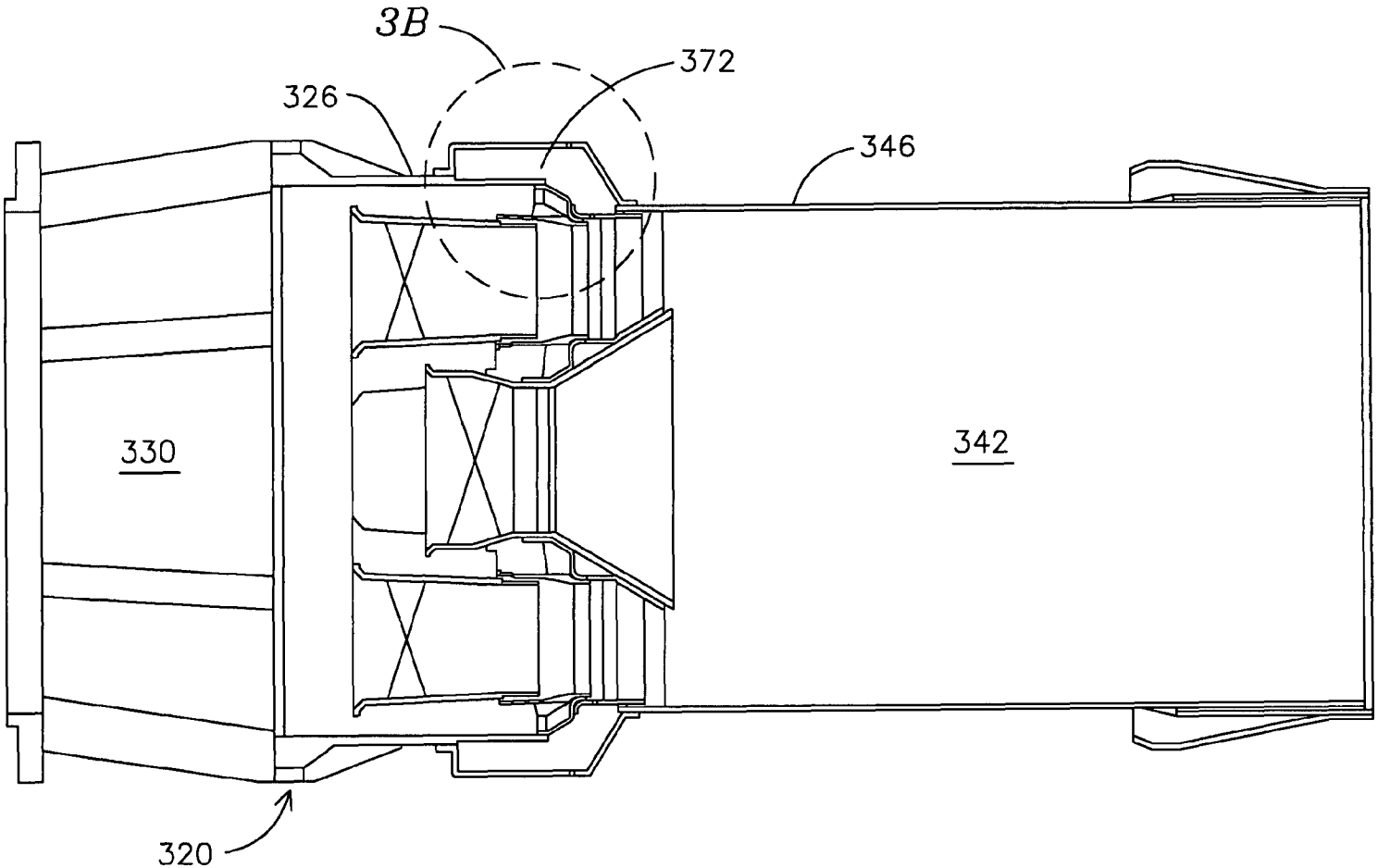
FIG. 3A provides a cross-sectional cut-away view of a combustor joined to a combustion chamber at a junction, wherein at the junction an enlarged resonator is provided.

FIGS. 3A and 3B provide an alternative design in which the cavity of the resonator is enlarged to provide more damping. As viewable in both FIGS. 3A and 3B, a resonator 370 comprises a cavity 372 is defined by an enlarged outer connector ring 364 to the exterior and also in large part to the upstream end 365 and the downstream end 367. The cavity 372 also is defined, to the interior, by a portion 327 of combustor housing 326, by a portion 376 of a baseplate shroud 334 of combustor 320, and by the outer baseplate ring 362. A small portion of the cavity 372, near its downstream end, is defined by an upstream end 343 of the combustion chamber housing 346 and a combustion chamber retaining ring 350. Whereas contacting adjacent components may be welded or otherwise sealed together to form cavities such as cavity 372 (and 271 in FIGS. 2A and 2B), it is appreciated that a ring such as retaining ring 350 alternatively may be provided, and may form a seal by compression fitting, welding, or other methods known to those skilled in the art. An inlet air hole 380 and an exit air hole 382 of the resonator 370 are shown. The exit air hole 382 communicates directly with the space within the combustion chamber (i.e., space 342 of FIG. 3A), while the inlet air hole 380 is in fluid communication with a flow of compressed air en route to the intake 330 of the combustor 320.

As discussed with regard to the embodiment depicted in FIGS. 2B and 2C, the resonator 370 curves in annular fashion around the junction 360 (and also extends more upstream of the junction 360, conforming exteriorly along portion of the combustor housing 326). While a single resonator 370 may extend circumferentially around the entire junction 360 (and may comprise one each or a plurality of inlet and exit air holes), in various embodiments the cavity 372 is partitioned by a plurality of baffles to form a plurality of adjacent resonators, each such individual resonator comprising at least one inlet air hole and at least one exit air hole. This provides for tuning different resonators, defined laterally by baffle plates, to a number of different frequencies.

The structural elements of the junction that are used to form this enlarged resonator cavity conforming to the junction and adjacent housing elements is not meant to be limiting. The enlargement may be achieved by modification of the outer structural elements of the adjacent combustor and/or combustion chamber, e.g., their respective housings.

Figure 4:
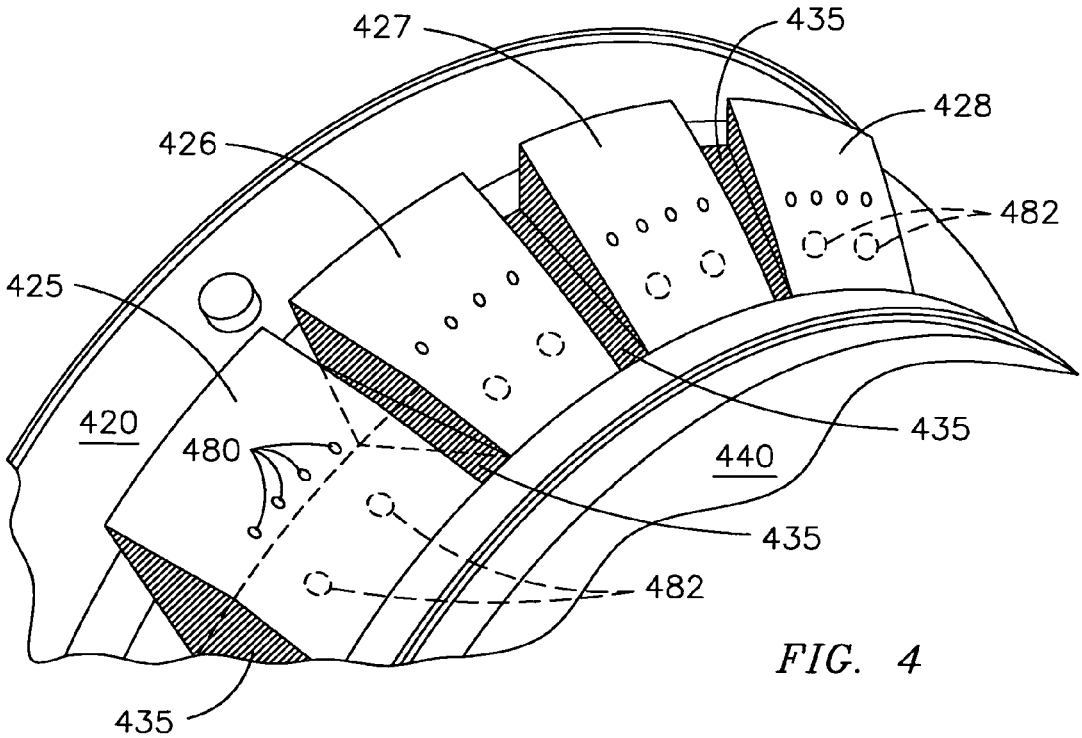
FIG. 4 provides a perspective view, from a side downstream point of view, of portions of a combustor and a combustion chamber joined at a junction, wherein at the junction is an arrangement of resonators separated by structural members.

FIG. 4 provides an alternative design in which resonators are separated by sections of structural reinforcement members. Depicted in FIG. 4 are four resonators 425, 426, 427 and 428 each with four inlet air holes 480. Each of the four resonators 425, 426, 427 and 428 also comprise two exit air holes 482, communicating with a space (not shown, see FIG. 2A) within the combustion chamber 440 (only partially depicted in the figure). A structural member 435 extends between these resonators to connect the combustion chamber 440 with a combustor 420 (also only partially depicted in the figure). This alternative design provides for the placement of structural members between resonators, to connect the combustion chamber 440 with the combustor 420, while leaving flexibility as to the shape of the resonators, such as resonators 425, 426, 427 and 428 as depicted in FIG. 4. It is appreciated that the resonators 425, 426, 427 and 428 are exemplary, and other designs, including the design depicted in FIGS. 3A and 3B may be utilized in an alternative design that provides structural members interspersed between such resonators about a junction. For example, the resonators could alternatively be built flush with the existing surface, rather than raised as shown in FIG. 4, and be separated by structural members such as 435. In such cases, a single baffle may be used to separate two adjacent resonators (such as at a midpoint, or along one edge, of the intervening structural member). Alternatively, baffles may be provided at both edges of the intervening structural member, resulting in a separate cavity interior to the intervening structural member.

Similarly, when embodiments comprise raised sections of resonators, such as depicted in FIG. 4 by 425, 426, 427 and 428, a single separating baffle may be placed between them (such as at a midpoint, or along one edge, of the intervening structural member). In other embodiments, wherein an inner junction ring is annularly coplanar with the intervening structural members, no baffles are required.

Also, it is appreciated that in some embodiments, an intervening structural member may be placed between some, but not all, adjacent resonators, so that some resonators are disposed adjacent to one another without an intervening structural member. In some of such embodiments, such latter adjacent resonators may share a common wall, which may be considered analogous to the baffles described above in regard to FIGS. 2B-3B.

The above described embodiments, relating to FIGS. 2B to 4, provide examples of resonators that fit directly around the upstream junction of the combustion chamber. However, these examples are not meant to be limiting of the various specific arrangements that may be effectuated in accordance with the present invention as claimed herein. For example, a greater portion of the resonator cavity at the junction may be situated to conform to the outer structure either of the combustor, or of the combustion chamber, so that a lesser relative portion exists over the junction and the other outer structure. (It is noted that FIGS. 3A and 3B provide one example of this approach, wherein most of the resonator cavity fits directly around the combustor, a portion of the cavity fits directly over the junction, and a very small, most downstream portion, fits over the upstream end of the combustion chamber.)

Also, the specific structures and terms used above are not meant to be limiting. For example, an outer baseplate ring is but one specific structure belonging to the group identified by the more generic term, inner junction ring, and an outer connector ring is but one specific structure belonging to the group identified by the more generic term, outer junction ring. Also, the downstream end of the cavity of resonators at the combustor/combustion chamber junction may be defined not only by a combustion chamber retaining ring, but by any other analogously functioning structure, which may simply be the upstream end of the combustion chamber housing. In various embodiments, these components define, at least partially, one or more cavities that are elements of respective Helmholtz-type resonators at the junction. This arrangement of elements at the junction is distinguishable from approaches that provide a separate combustor insert that is inserted between a combustor and a combustor chamber, in which Helmholtz resonators are displaced radially from the insert structure and are connected thereto by tubes.

The number of inlet air holes, outlet air holes, and openings in general provided in the figures are meant to be exemplary, and not limiting in any way. Any number of inlet and outlet openings may be provided for specific embodiments. Further, as used herein, the term "opening" when referring to an open passage, such as an exit air hole, between a Helmholtz resonator cavity and a space within a combustion chamber, is meant to be construed as merely the opening, and not including a tube structure to extend the effective length of a throat of the Helmholtz resonator. That is, in various embodiments, the throat length for purposes of establishing the performance of a Helmholtz resonator is the length of an opening that provides for communication between the resonator cavity and the combustion chamber space through the structural member (s) there between, and wherein there is no tube extending, in either direction, beyond the respective inner and outer surfaces of the structural member(s). The following discussion is provided to further define what is meant by throat length, and to discuss how this relates to resonator design and performance.

Figure 5:
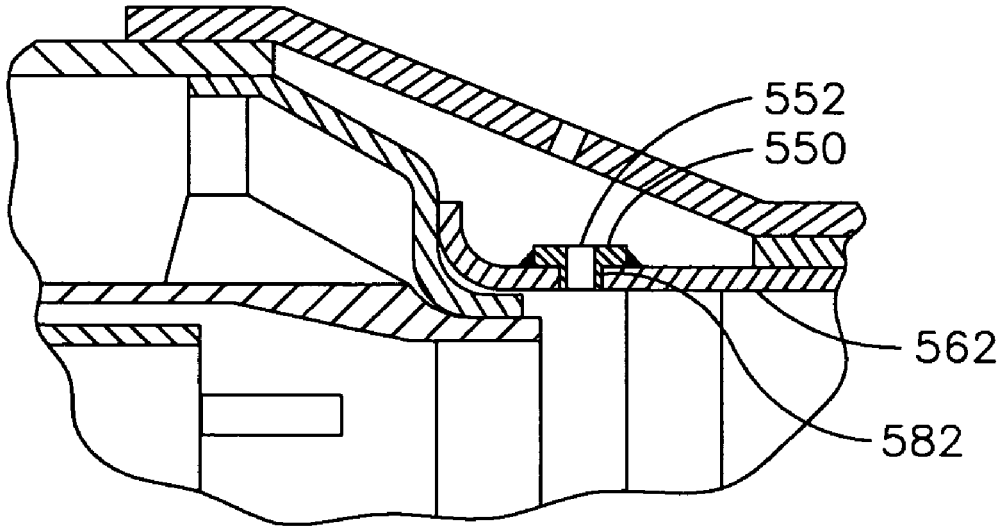
FIG. 5 provides a cross-sectional cut-away view of a combustor joined to a combustion chamber at a junction, such as is shown in FIG. 2B, wherein a plug is provided to lengthen the effective length of an opening.

In all embodiments of the present invention, the number of inlet holes and exit holes for each resonator is determined for a desired performance objective. The performance objective may be determined, at least in part, by use of the equation:

$$f=c/2\pi\sqrt{A/\mathrm{Leff}(V)}$$

where c is the speed of sound in the resonator volume, A is the cross-sectional area of the throat, Leff is the effective length of the throat, and V is the resonator volume (i.e., the volume of the cavity of the resonator). The throats in embodiments of the present invention, such as those disclosed above, are comprised not of tubes extending into the cavity of the resonator, but rather are comprised of the hole in the structure(s) separating the resonator cavity from the space within the combustion chamber. Further, for each particular resonator comprising a particular resonator cavity defining a resonator volume, one, or two or more, up to a plurality of openings to the combustion chamber space may be provided. Such use of multiple throats affects the performance of the respective resonator. Further regarding effective throat length, plugs with holes may be provided to extend the effective throat length in various embodiments. An example, not to be limiting, is provided in FIG. 5, which depicts a cross sectional view similar to FIG. 2B, however additionally comprising a plug 550 comprising a hole 552, wherein the plug 550 is welded to the surface of an inner junction ring 562 so that the hole 552 effectively lengthens a throat length of the hole (here 552) formed through the inner junction ring 562. It is noted that to achieve a desired diameter of the hole 552, the hole 582 in the inner junction ring 562 may be drilled sufficiently wide to accommodate the relatively wider diameter of the plug 550. More generally, plugs with holes such as plug 550 may similarly be provided to the inlet air holes, as desired, in various embodiments.

Likewise, a multiple number of inlet air holes may be provided for a particular resonator. Further, it is appreciated that although in the embodiments depicted and discussed above, the Helmholtz-type resonators comprised both exit air holes communicating to the combustion chamber space, and inlet air holes communicating exteriorly, that the latter holes are not required for all embodiments of the present invention.

Embodiments of the present invention may be used both in 50 Hertz and in 60 Hertz turbine engines, and are well-adapted for use in can-annular types of gas turbine engines. Can-annular gas turbine engine designs are well-known in the art. A can-annular type of combustion system, for example, typically comprises several separate can-shaped combustor/combustion chamber assemblies, distributed on a circle perpendicular to the symmetry axis of the engine.

All patents, patent applications, patent publications, and other publications referenced herein are hereby incorporated by reference in this application in order to more fully describe the state of the art to which the present invention pertains, to provide such teachings as are generally known to those skilled in the art.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

What is claimed is:

1. A can-annular gas turbine engine comprising:

a combustor defined by an exterior combustor housing;

a combustion chamber defined by an exterior housing and adapted to be joined to the combustor housing at an upstream junction; and a plurality of Helmholtz-type resonators comprising respective cavities at the upstream junction, each of said resonators comprising one or more openings communicating with the combustion chamber, the overall length of each of said openings defining a respective throat length for the respective resonator;

wherein the cavities are formed at least in part between an inner junction ring and an outer junction ring of the junction, wherein the inner junction ring and outer junction ring are separate from the combustor housing and the exterior housing, and wherein at least a portion of the outer junction ring axially overlaps and is radially outward of at least a portion of the inner junction ring.

2. The can-annular gas turbine engine of claim 1, wherein at least one of the plurality of Helmholtz-type resonators additionally comprises one or more inlet openings, the one or more inlet openings disposed along the outer junction ring.

3. The can-annular gas turbine engine of claim 1, wherein adjacent resonator cavities are separated by respective baffles.

4. The can-annular gas turbine engine of claim 1, wherein tubes are not provided to extend the respective throat length.

5. The can-annular gas turbine engine of claim 1, wherein the plurality of Helmholtz-type resonators comprises two or more different resonator sizes, each respective resonator size designed to damp a different frequency range between about 1,000 and about 5,000 cycles per second.

6. The can-annular gas turbine engine of claim 5, wherein the respective different frequency ranges of each of the two or more different resonator sizes overlap.

7. A junction between a combustor and a combustion chamber of a gas turbine engine, the junction comprising one or more Helmholtz-type resonators each comprising a chamber, wherein each chamber is defined, at least partially, by a more exteriorly disposed outer junction ring and by a more interiorly disposed inner junction ring, wherein the inner junction ring and outer junction ring are separate from the combustor housing and the exterior housing, and wherein at least a portion of the outer junction ring axially overlaps at least a portion of the inner junction ring, and wherein baffles connect with the outer junction ring and the inner junction ring to separate respective adjacent cavities.

8. The junction of claim 7, wherein each of the chambers communicates with a space in a combustion chamber through one or more openings, the overall length of each of said openings defining a respective throat length for the respective resonator, and wherein tubes are not provided to extend the respective throat length.

9. The junction of claim 7, wherein each of the chambers communicates with a space in a combustion chamber through one or more openings, and wherein an effective length of a particular one or more of said openings is extended by a plug with a hole.

10. A gas turbine engine comprising the junction of claim 7.

11. A gas turbine engine combustor/combustion chamber assembly joined at a junction, comprising at the junction a plurality of Helmholtz-type resonators extending radially outward from the junction, each of the resonators comprising a chamber with an outward side defined, at least in part, by a radially outward member of the junction, wherein the inner junction ring and outer junction ring are separate from the combustor housing and the exterior housing, and an inward side defined, at least in part, by a radially inward member of the junction, wherein at least a portion of the radially outward member axially overlaps at least a portion of the radially inward member, and wherein the radially inward member comprises one or more openings communicating with a combustion chamber, the overall length of each of said openings defining a respective throat length for the respective resonator.

12. The gas turbine engine combustor/combustion chamber assembly of claim 11, wherein an intervening structural member is disposed between respective adjacent resonators of said plurality of resonators, wherein the structural member connects the combustor with the combustion chamber.

13. A can-annular gas turbine engine comprising:

a combustor;

a combustion chamber;

a junction between the combustor and the combustion chamber, comprising an inner junction ring and an outer junction ring, wherein the inner junction ring and outer junction ring are separate from the combustor housing and the exterior housing, and wherein at least a portion of the outer junction ring axially overlaps and is radially outward of at least a portion of the inner junction ring; and a plurality of Helmholtz-type resonators comprising respective cavities at the junction, each of said resonators comprising one or more openings communicating with the combustion chamber, the overall length of each of said openings defining a respective throat length for the respective resonator;

wherein the cavities are formed at least in part between the inner junction ring and the outer junction ring, and wherein said cavities are of one or more sizes for damping one or more flame-generated acoustic frequencies.

14. The can-annular gas turbine engine of claim 13, wherein at least one of the plurality Helmholtz-type resonators additionally comprises one or more inlet openings, the one or more inlet openings disposed along the outer junction ring.

15. The can-annular gas turbine engine of claim 13, wherein adjacent resonator cavities are separated by respective baffles.

16. The can-annular gas turbine engine of claim 13, wherein tubes are not provided to extend the respective throat length.

17. The can-annular gas turbine engine of claim 13, wherein the plurality of Helmholtz-type resonators comprise two or more different resonator sizes, each respective resonator size designed to damp a different frequency range between about 1,000 and about 5,000 cycles per second.

18. The can-annular gas turbine engine of claim 17, wherein the respective different frequency ranges of each of the two or more different resonator sizes overlap.

19. The can-annular gas turbine engine of claim 13, additionally comprising a plug comprising a hole, the hole positioned in alignment with one of said one or more openings communicating with the combustion chamber for extending the respective throat length.

* * * * *